US009837706B2

(12) United States Patent
Neubecker et al.

(10) Patent No.: US 9,837,706 B2
(45) Date of Patent: Dec. 5, 2017

(54) DIRECTING ELECTROMAGNETIC WAVES IN VEHICLE COMMUNICATIONS

(71) Applicant: Ford Global Technologies, LLC, Dearborn, MI (US)

(72) Inventors: Cynthia M. Neubecker, Westland, MI (US); Perry Robinson MacNeille, Lathrup Village, MI (US); Omar Makke, Lyon Township, MI (US); Dehua Cui, Northville, MI (US); David Allen Kowalski, Toledo, OH (US); Allen R. Murray, Lake Orion, MI (US); Oliver Lei, Windsor (CA)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/047,883

(22) Filed: Feb. 19, 2016

(65) Prior Publication Data

US 2017/0244160 A1 Aug. 24, 2017

(51) Int. Cl.

| | |
|---|---|
| ***G08G 1/00*** | (2006.01) |
| ***H01Q 1/32*** | (2006.01) |
| ***G08G 1/087*** | (2006.01) |
| ***G08G 1/09*** | (2006.01) |
| ***H01Q 3/14*** | (2006.01) |

(52) U.S. Cl.

CPC ..... *H01Q 1/3208* (2013.01); *G08G 1/087* (2013.01); *G08G 1/091* (2013.01); *H01Q 3/14* (2013.01)

(58) Field of Classification Search

USPC ..... 701/117

See application file for complete search history.

(56) References Cited

U.S. PATENT DOCUMENTS 4,709,240 A 11/1987 Bordenave
5,581,257 A * 12/1996 Greene ..... C30B 33/00 235/375
5,795,043 A 8/1998 Johnson et al.
(Continued)

FOREIGN PATENT DOCUMENTS

EP 2390857 A1 11/2011
EP 3012912 A1 4/2016
(Continued)

OTHER PUBLICATIONS

Yamasaki, Y., A Beam Controlled Array Antenna for Road to Vehicle Communications, Conference: Intelligent Transportation Systems, 2001, pp. 1-2, http://www.researchgate.net/publication/2204073105_A_beam_controlled_array_antenna_for_road_to_vehicle_communications.

(Continued)

*Primary Examiner* — Tyler Paige
(74) *Attorney, Agent, or Firm* — Frank A. MacKenzie; Brooks Kushman P.C.

(57) ABSTRACT

A vehicle may include a conductive housing surrounding an antenna and defining an aperture having a size at least equal to a wavelength of signals radiated by the antenna. A controller may be configured to orient the conductive housing to direct the aperture at a direction of travel to guide electromagnetic radiation from the antenna. The controller may orient the conductive housing in response to receiving a cooperative adaptive cruise control signal from an established platoon of vehicles.

16 Claims, 5 Drawing Sheets

(56) References Cited

U.S. PATENT DOCUMENTS 5,935,190 A * 8/1999 Davis ..... G01S 13/62 340/936
6,150,989 A 11/2000 Aubry
7,103,460 B1 * 9/2006 Breed ..... B60C 23/0408 701/29.1
7,327,322 B2 * 2/2008 Capps ..... H01Q 1/44 343/711
7,355,525 B2 * 4/2008 Tengler ..... G08G 1/0962 340/10.2
8,280,592 B2 * 10/2012 Wisniowski ..... H01Q 1/3208 342/377
8,373,577 B2 2/2013 Ieda et al.
2001/0044315 A1 * 11/2001 Aoki ..... H04L 1/0007 455/524
2002/0060640 A1 * 5/2002 Davis ..... G01S 13/583 342/104
2003/0042303 A1 * 3/2003 Tsikos ..... G06K 7/10594 235/384
2003/0107481 A1 * 6/2003 Sawafuji ..... B60C 23/0416 340/442
2004/0023678 A1 * 2/2004 Fredriksson ..... G06F 1/14 455/502
2004/0155796 A1 * 8/2004 Fukasawa ..... G06K 7/10336 340/928
2004/0203390 A1 * 10/2004 Inoue ..... H01Q 1/325 455/41.2
2005/0137786 A1 * 6/2005 Breed ..... B60N 2/2863 701/482
2006/0012534 A1 1/2006 Duncan et al.
2006/0167784 A1 * 7/2006 Hoffberg ..... G06Q 20/401 705/37
2007/0079012 A1 * 4/2007 Walker ..... G06Q 20/32 709/249
2007/0087756 A1 * 4/2007 Hoffberg ..... G06Q 10/0631 455/450
2010/0267379 A1 * 10/2010 Stahlin ..... G08G 1/096716 455/426.1
2011/0098877 A1 * 4/2011 Stahlin ..... G08G 1/161 701/31.4
2011/0267222 A1 * 11/2011 Craig ..... G01S 13/878 342/25 B
2013/0141281 A1 * 6/2013 Hanisch ..... H01Q 3/24 342/374
2013/0297196 A1 * 11/2013 Shida ..... B60W 30/143 701/119
2013/0307747 A1 11/2013 Koide
2014/0316865 A1 10/2014 Okamoto
2016/0011318 A1 * 1/2016 Cohen ..... G01S 19/05 342/357.26

FOREIGN PATENT DOCUMENTS

GB 493708 A 4/1937
JP 2004304542 A 10/2004
JP 2016183877 A 10/2016
WO 2010045966 A1 4/2010
WO 20151047177 A1 4/2015

OTHER PUBLICATIONS

GB Search Report dated Jun. 21, 2017 for corresponding GB Application No. 1702544.6, 5 pages.

* cited by examiner

DIRECTING ELECTROMAGNETIC WAVES IN VEHICLE COMMUNICATIONS

TECHNICAL FIELD

The present disclosure relates to vehicle-to-vehicle communications.

BACKGROUND

Many vehicles are equipped with systems purposed for communication with other vehicles or objects in the vicinity. These systems may communicate information related to vehicle speed, direction, or other important parameters. Omnidirectional antennas may allow indeterminate communication with all other vehicles and objects in the vicinity. Communication with other vehicles or objects may become unavailable when too many vehicles attempt communication in the vicinity.

SUMMARY

A vehicle may include a conductive housing surrounding an antenna and defining an aperture having a size at least equal to a wavelength of signals radiated by the antenna. A controller may be configured to orient the housing to point the aperture in a direction opposite the forward vehicle, and after relaying the signal, orient the housing in a direction toward the forward vehicle. The controller may operate in response to receiving a cooperative control signal from a platooned forward vehicle.

The controller may be further configured to adjust an elevation angle of the aperture, with respect to the antenna, based on an upcoming gantry having a toll collection system. The controller may be further configured to adjust a size of the aperture to decrease attenuation of electromagnetic radiation transmitted from the antenna to outside the housing. The aperture may be an iris diaphragm. The antenna may transmit a signal having a frequency between 5.850 and 5.925 GHz.

DETAILED DESCRIPTION

Figure 1:
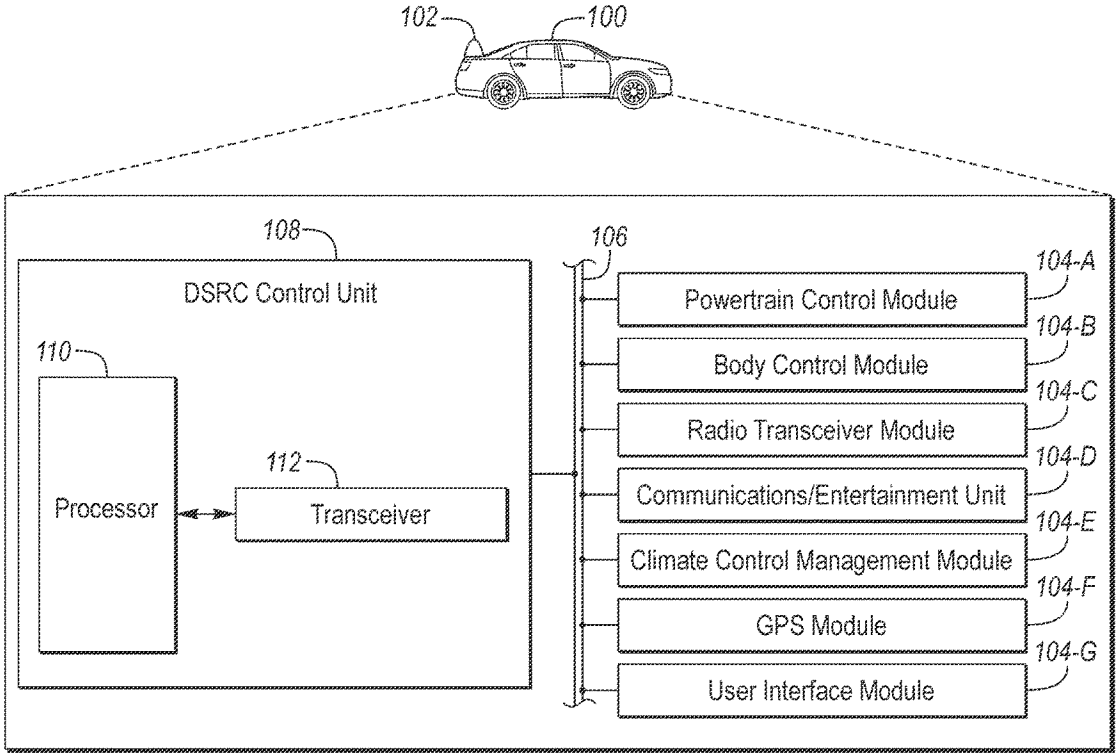
FIG. 1 is a schematic diagram depicting an example of a vehicle having an apparatus purposed to direct electromagnetic waves.

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Many vehicles today employ vehicle-to-vehicle ("V2V") communications to improve cooperation among vehicles and improve customer satisfaction. V2V communications may relay data related to location, velocity, acceleration, traffic conditions, status of traffic signals, and other information as required. V2V communications may use dedicated short-range communication ("DSRC") and 802.11p protocols to communicate. Many protocols may facilitate V2V communications. These protocols may be based on an ad-hoc or decentralized network design, or a separate protocol requiring a structured network design may be used.

A DSRC system may be connected to an antenna assembly to propagate electromagnetic waves. An antenna assembly may include an antenna having a monopole, dipole, or other wave propagation configuration. The antenna assembly may also include a transceiver connected to the antenna. The transceiver may use any frequency on the electromagnetic spectrum to communicate information. For example, the system may use electromagnetic radiation within the radio frequency band. An antenna assembly may also include a processor or array of processors used to create or prepare data for transmission. A frequency band near 5.9 GHz may be used to facilitate V2V communications. These bands may be separated into channels to minimize cross-talk between designated communication paths.

The antenna may be omnidirectional. The antenna may be configured to transmit and receive electromagnetic waves from any direction or a plurality of directions. Use of omnidirectional antennas may cause congested communication paths among vehicles and objects, which may result in a poor reception of information. DSRC attempts to address this issue by using the wireless access in vehicular environments ("WAVE") protocol's media access control, WAVE simple message protocol, and channel selection. Although these methods may alleviate certain levels of congestion and interference, the methods may provide little benefit in areas with high vehicular traffic. The transmit power and receive sensitivity of omnidirectional antennas may be limited to further prevent congestion.

A directional antenna may be adapted to direct waves in a particular direction. For example, the antenna may direct waves using a physical aperture, synthetic aperture, parabolic reflector, fractal structure, horn structure, etc. The antenna may be configured to transmit and receive signals from vehicles or objects within a front and rear acceptance angle. The antenna may be configured to transmit and receive signals in a vertical direction. A directional antenna, as specified above, may have increased transmit power and reception sensitivity with reduced congestion and interference.

A housing may surround all or part of the antenna to deflect, impede, attenuate, redirect, stop, or abate signals transmitted or received from the antenna. The housing may surround the other electronic devices associated with the antenna or controllers for the housing. The housing may be made of a conductive material to shield the antenna from electromagnetic radiation. The conductive material may be of any type (e.g., copper, aluminum, graphene, gold, silver, calcium). The conductive material may be grounded to the vehicle. The housing may also be made of a material designed to attenuate magnetic signals. The material designed to attenuate may magnetically attenuate the signal (i.e., materials with high magnetic permeability causes eddy currents to oppose the magnetic field), or the material may impede the signal through structure. The housing may be made of a combination of these materials to provide improved electromagnetic shielding. The housing may attenuate signals from all directions or may allow signals from designated directions (e.g., vertical).

The housing may define an aperture. The aperture may be configured to allow signals to be transmitted and received from the antenna in a desired direction or shape. The aperture may have a circular, rectangular, or other geometric shape. The circular aperture may be formed of a diaphragm comprised of blades mounted on the housing. The size of the aperture may be adjusted by the blades to allow variable amounts of electromagnetic radiation or different shapes of electromagnetic radiation. The size may be manually adjustable by a user or automatically adjusted by a controller as is known in the art. The entrance to the housing created by the aperture may be protected from the elements by a piece of glass, screen, or opaque element.

A rectangular aperture may be formed using a cutout or adjustable perpendicular plates. The perpendicular plates may be adjusted using a screw drive along with a rack or gear for each of the two directions of movement. The perpendicular plates may be made of materials similar to the housing material. The perpendicular plates may be made of different materials to provide different waveguide characteristics. The rectangular aperture may be formed using two pairs of opposed plates to maintain the center of the aperture in line with the antenna, instead of offset.

The housing may be adjusted to change the direction of the aperture. There are numerous ways to adjust the orientation of the housing known to those having skill in the art. For example, a screw drive may cooperate with a rack to rotate the housing about a substantially horizontal plane. This may adjust the direction of the signal about an azimuth angle. The rack may be mounted on bearings to reduce friction between the rack and a chassis mounted to the vehicle. A DC motor connected to a controller may actuate the screw drive. Induction or permanent magnet motors may also be used. The DC motor may be coupled with an encoder or other locating device to provide location feedback to the controller. The controller may be configured with maximum encoder positions to prevent twisting of cabling connecting the antenna to other electronics.

The housing may be adjusted about a horizon or elevation angle. For example, a sector gear may provide a range of motion of greater than 90° to adjust the elevation angle of the housing. The sector gear may be mounted to cooperate with a second drive screw mounted to an internal chassis containing the housing. The sector gear may be mounted on a bearing to reduce friction. The screw drive may be actuated by a DC motor. The DC motor may be connected to a controller. The DC motor may also have an encoder to provide feedback to the controller.

The aperture may be configured to direct electromagnetic waves, signals, or radiation by being sized at least one wavelength in width or diameter. The aperture may be sized manually or automatically to properly direct the electromagnetic waves of a given wavelength. Waves experience diffraction when confronted with an aperture. An aperture sized too small for the waves will not direct the waves in a desirable direction, if at all. A DSRC signal having a frequency of roughly 5.9 GHz may have a wavelength of about 2.0 inches. The aperture should be sized at least two inches, preferably greater than two, to provide adequate directional control over the signal.

The directional antenna as described above may be used in addition to an omnidirectional antenna because V2V standards require at least one omnidirectional antenna. This configuration would allow extended range from the directional antenna through increased transmission or reception strength, yet meet the standard requiring omnidirectional support.

The directional antenna may be used in combination with map and location data to communicate with known or expected devices. For instance, the directional antenna may be directed toward an upcoming traffic light, oncoming traffic at an intersection, or directed toward emergency assistance. A disabled vehicle on the side of a road may use the directional antenna to signal only oncoming traffic for assistance because passed vehicles are unlikely to turn around. The directional antenna may also notify oncoming emergency vehicles of the location of the vehicle at an increased range from the omnidirectional DSRC antenna because the directional antenna may have an increased transmission or reception power. The directional antenna may be used by emergency vehicles to notify vehicles in the travel path to move out of the way. For instance, the directional antenna may be used to notify vehicles in the same direction of travel or on a desired travel path.

The directional antenna may be oriented vertically to communicate with overhead gantries. For instance, a toll collection system may be mounted to a gantry to collect toll information from vehicles. Vertical orientation of the directional antenna in light of an upcoming gantry may eliminate interference from other vehicles and result in improved communication with the toll collector.

The directional antenna may be used to improve congestion and interference in busy intersections by directing DSRC signals from the traffic signal or traffic system to specific traffic lanes or directions. Oncoming traffic may be notified of the approaching signal, while vehicles already through the traffic signal may have reduced congestion and interference. The controller of the housing may orient the housing such that the aperture points to a direction of oncoming traffic and avoids outgoing traffic.

The directional antenna may be used to improve cooperative adaptive cruise control. Cooperative adaptive cruise control ("CACC") provides collaboration among vehicles in a platoon to communicate and match speeds. CACC can reduce oscillations in vehicle speed by removing latency from the system. CACC may be improved using the directional antenna as described above by isolating communications within the platoon. Omnidirectional antennas create substantial interference and handshaking between oncoming platoons and platoons in other lanes. This unfavorable consequence of omnidirectional antennas may be reduced using a directional antenna.

CACC may utilize a directional antenna in a platoon of five cars where the first vehicle of the platoon sends a signal in a rearward direction. The second vehicle may then receive the signal and send an acknowledgment to the first vehicle. The first vehicle may then continue to listen for a forward vehicle, by intermittently rotating the aperture of the direction antenna forward, and rotate backward to communicate with the second vehicle. The CACC system may be configured with time-domain multiplexing, which synchronizes the DSRC signal's transmit and receive sequences. Information communicated throughout the platoon may include speed, direction, intended destination, and other information necessary to facilitate CACC.

A vehicle event may necessitate CACC communications among the vehicle platoon. For example, a forward vehicle may receive a flat tire indication from its vehicle control system. The forward or leading vehicle may need to indicate this information to other vehicles in the platoon to notify other vehicles of debris or an impending deceleration. The forward vehicle may orient a housing into a direction opposite of travel, e.g., behind, to notify follower vehicles that there is an emergent situation.

Referring now to FIG. 1, A vehicle 100 includes a directional antenna 102. The directional antenna may be mounted to the roof, interior, undercarriage, or other location of the vehicle. The vehicle may have a powertrain control module 104-A, a body control module 104-B, a radio transceiver module 104-C, a communications and entertainment unit 104-D, a climate control management module 104-E, a GPS module 104-F, and a user interface module 104-G. The modules may be configured to communicate via a communications network 106 (e.g., CAN). A DSRC 108 control unit may be configured to communicate on the communications network 106 or part of the other modules specified above. The DSRC 108 may include a processor 110 and memory to process and send data on the network 106 and prepare data for transmission via the transceiver 112.

Figure 2:
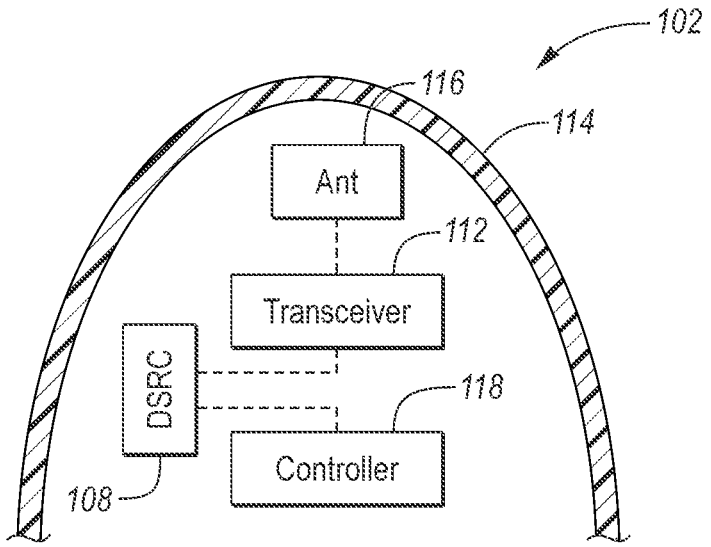
FIG. 2 is a section view of a housing fitted to hold an antenna assembly.

Referring now to FIG. 2, a cross-section of the directional antenna 102 is shown. The antenna 102 may have a conductive housing 114. The conductive housing may include separate layers to provide radio wave shielding. The conductive housing 114 may surround at least a portion of the antenna 116. The antenna 116 may be positioned in the center of the housing 114. The antenna may be electrically connected to a transceiver 112. The transceiver 112 may propagate signals to the antenna for transmission or receive signals from the antenna to decipher the contents. The DSRC 108 may communicate with a controller 118 to determine the proper direction of the directional antenna 102. The DSRC 108 and the controller 118 may be part of the same integrated circuit. The controller 118 may determine the proper direction of the directional antenna 102 by received information from other vehicles or objects. The controller 118 may determine proper direction based on GPS location information or previously receiving data. The controller 118 may be configured to control actuators or motors configured to adjust the relative location of the housing 114. The controller may be configured to receive indication of relative motion from sensors or encoders on the motors.

Figure 3:
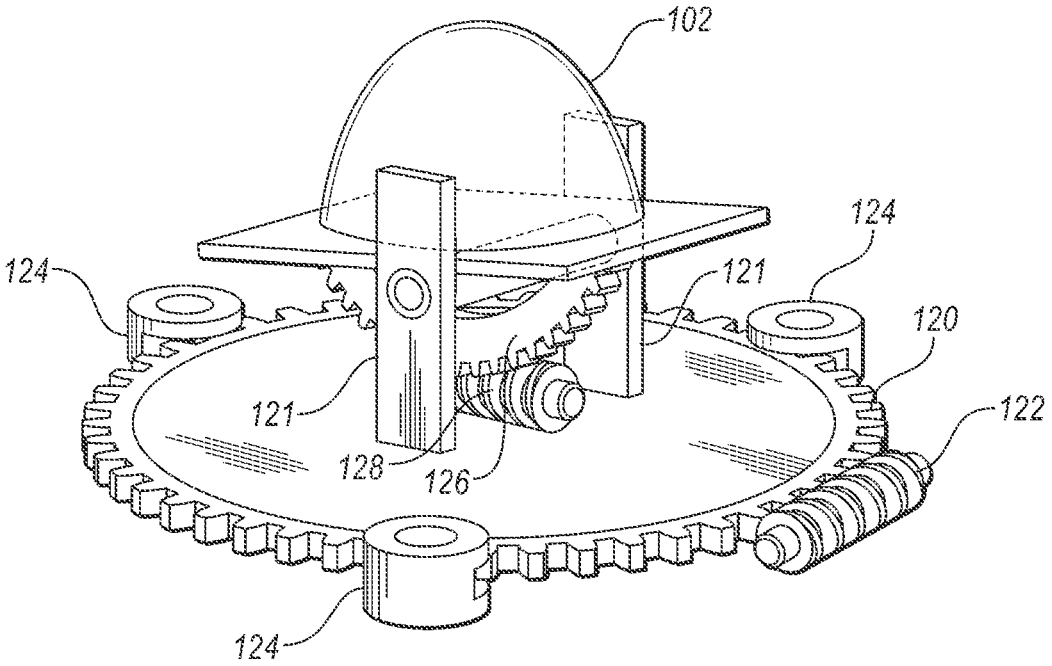
FIG. 3 is an isometric view of a mount for the housing.

FIG. 3 depicts an embodiment of the housing movement system. A ring gear 120 has an attached drive screw 122 to rotate the housing about an axis. The ring gear may be mounted to a set of bearings 124, which allow movement between the directional antenna 102 and the vehicle (not shown). Struts 121 extend radially from the ring gear 120. Mounted in the center of the struts is a sector gear 126 along with the directional antenna 102. The directional antenna 102 is moved about the vertical axis or elevation angle via the sector gear 126. The sector gear 126 may be mounted in a sector gear housing to restrict translational movement. The sector gear 126 may be actuated using a sector gear drive screw 128. Both of the drive screws 122, 128 may be mechanically connected to an electromagnetic drive controlled by a controller (not shown). Each of the drive screws 122, 128 may be fitted with encoders to indicate position to the controller.

Figure 4:
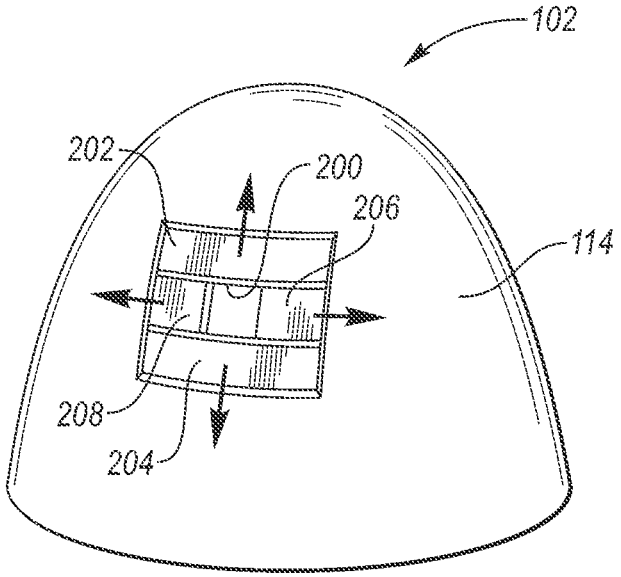
FIG. 4 is an isometric view of a housing defining a rectangular aperture.

FIG. 4 depicts at least one embodiment of the directional antenna 102. The directional antenna 102 has a housing 114 capable of attenuating electromagnetic signals and a rectangular aperture 200. The rectangular aperture 200 is sized to properly direct incoming or outgoing signals from the antenna (not shown). The housing 114 may include two pairs of perpendicular plates 202, 208 and 204, 206 configured to alter the size of the aperture 200. The plates 202, 208 and plates 204, 206 may be actuated by a pair of screw drives (not shown) connected to electric motors and a controller. The size of the aperture 200 may be adapted to have a width and height at least one wavelength of the incoming or outgoing signals to limit diffraction.

Figure 5:
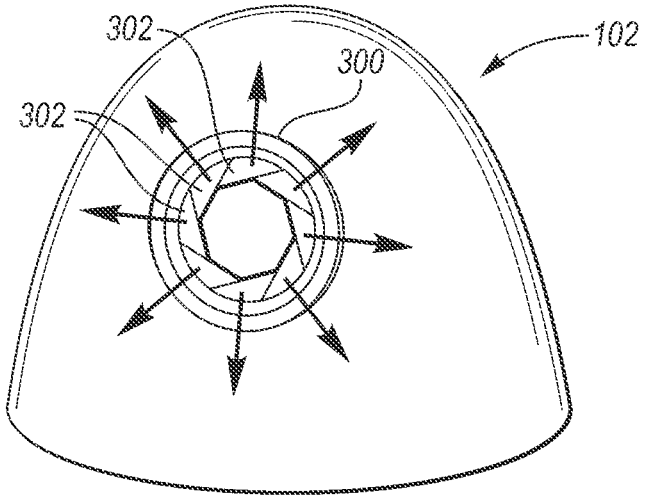
FIG. 5 is an isometric view of a housing defining a circular aperture.

FIG. 5 depicts at least one embodiment of the directional antenna 102. The housing 114 may define an aperture 300 having a circular shape. The aperture 300 may be an iris diaphragm type. The aperture may be defined by rotating blades 302 capable of reciprocally changing the size of the aperture. The aperture 300 may be automatically sized to match a specified signal frequency or wavelength. For instance, a 5.9 GHz signal may have a wavelength of about two inches. The aperture may be sized with an internal diameter of at least two inches to provide adequate steering of the signal.

Figure 6A:
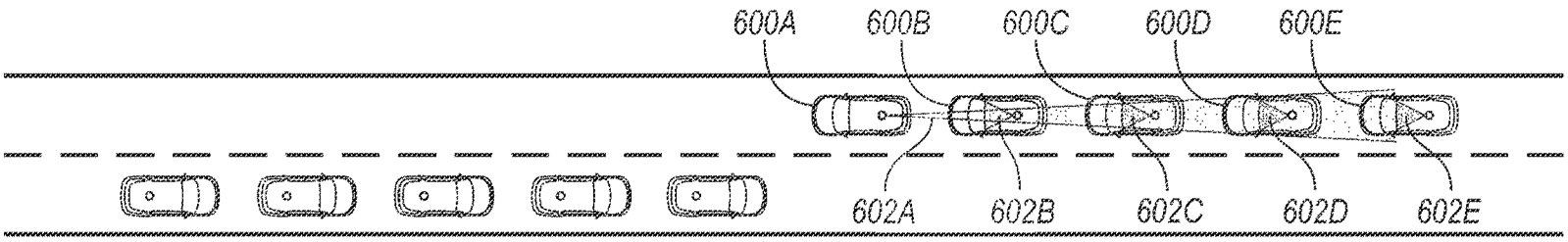
FIGS. 6A and 6B are schematic diagrams of platoons of vehicles utilizing an apparatus purposed to direct electromagnetic waves.
Figure 6B:
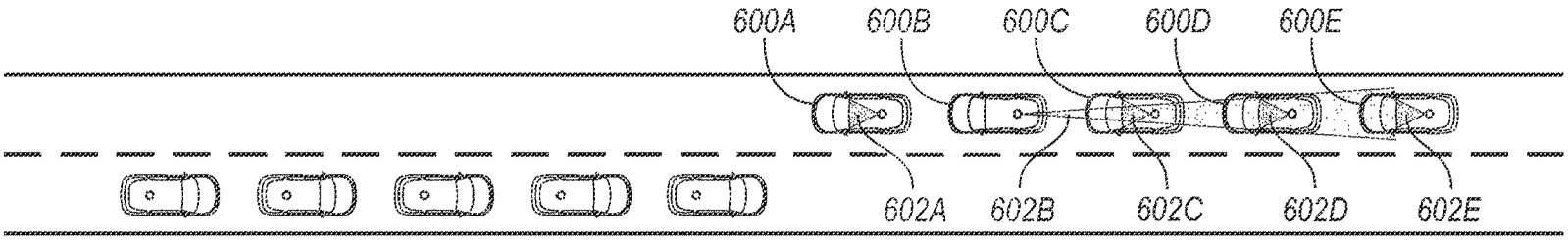

Now referring to FIG. 6A at least one embodiment of a directional antenna is depicted. The directional antenna may be mounted to the roof of a vehicle 600A. Vehicle 600A may include a DSRC transceiver capable of V2V communications. Vehicle 600A may send a signal 602A rearward to the platoon of vehicles t600B, 600C, 600D, 600E of one lane. The next vehicle in the platoon 600B receives a signal from vehicle 600A via a directional antenna facing in the forward direction. The directional antenna of vehicle 600B may then rotate rearward to direct communications to the rest of the platoon (e.g., 600C, 600D, 600E, etc.). The directional nature of antenna allows for increased receive sensitivity and transmit strength. As shown in FIG. 6B the signals and reception areas 602A 602B, 602C, 602D, 602E may be limited to the lane of the platoon 600A, 600B, 600C, 600D, 600E.

Figure 7:
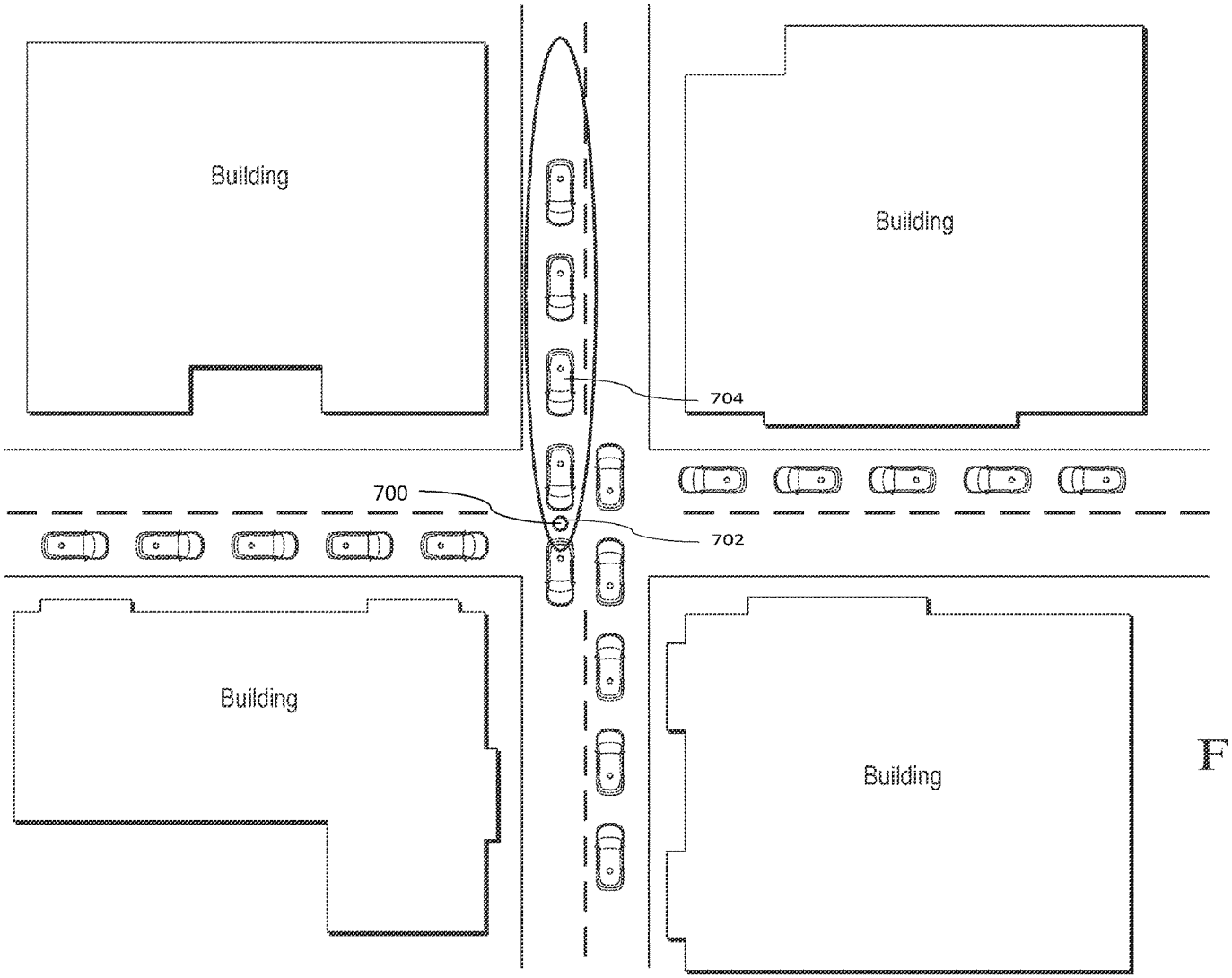
FIG. 7 is a schematic diagram of a traffic signal fitted with an apparatus purposed to direct electromagnetic waves.

Now referring to FIG. 7, in at least another embodiment a directional antenna 702 may be placed on a traffic signal or indicator 700 to notify particular drivers of signal status. Any value a traffic signal 700 can provide a vehicle 704 may be diminished after the vehicle has passed through the intersection. The directional antenna 702 may provide DSRC communication to oncoming vehicles 704 or vehicles that would receive value from the indication. In addition, a vehicle 704 configured with a directional antenna 702 may recognize an upcoming traffic signal through GPS or other V2V communications. The vehicle 704 may then orient the directional antenna 702 to the expected location based on current position and the position of the traffic signal. This could provide early indication of signal status to the vehicle 704 and reduce interference from other signals.

The processes, methods, or algorithms disclosed herein may be deliverable to or implemented by a processing device, controller, or computer, which may include any existing programmable electronic control unit or dedicated electronic control unit. Similarly, the processes, methods, or algorithms may be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms may also be implemented in a software executable object. Alternatively, the processes, methods, or algorithms may be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components.

The words used in the specification are words of description rather than limitation, and it is understood that various changes may be made without departing from the spirit and scope of the disclosure. As previously described, the features of various embodiments may be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

What is claimed is:

1. A vehicle comprising:

a controller configured to, responsive to occurrence of a vehicle event while the vehicle is participating in a platoon, orient a conductive housing having an antenna therein to point an aperture defined thereby in a direction opposite vehicle travel to transmit data via the antenna about the vehicle event to a following vehicle of the platoon, and thereafter orient the housing to point the aperture in a direction of vehicle travel, wherein the controller is further programmed to size the aperture to have an inner diameter at least equal to one wavelength of electromagnetic radiation transmitted from the antenna.

2. The vehicle of claim 1, wherein the controller is further programmed to limit a minimum size of the inner diameter to two inches.

3. The vehicle of claim 1, wherein the controller is further programmed to transmit the data via the antenna at a frequency between 5.850 and 5.925 GHz.

4. The vehicle of claim 1, wherein the vehicle event is indication of a flat tire.

5. A traffic system comprising:

a conductive housing having a diaphragm defining an aperture with a diameter greater than one wavelength of electromagnetic radiation transmitted by an antenna therein; and a controller configured to, responsive to receiving a request to change a traffic indicator, orient the housing to point the aperture in a direction of oncoming traffic affected by the request to direct transmissions via the antenna about the change to vehicles in the oncoming traffic.

6. The traffic system of claim 5, wherein the controller is further programmed to size the aperture to have an inner diameter at least equal to one wavelength of electromagnetic radiation transmitted from the antenna.

7. The traffic system of claim 5, wherein the controller is further programmed to limit a minimum size of the inner diameter to two inches.

8. The traffic system of claim 5, wherein the antenna is configured to transmit data via the antenna at a frequency between 5.850 and 5.925 GHz.

9. The traffic system of claim 5, wherein the controller is further programmed to orient the housing to point the aperture in the direction of oncoming traffic affected by an emergency vehicle approaching the traffic system.

10. A vehicle comprising:

a controller configured to, responsive to occurrence of a vehicle event while the vehicle is participating in a platoon, orient a conductive housing having an antenna therein to point an aperture defined thereby in a direction opposite vehicle travel to transmit data via the antenna about the vehicle event to a following vehicle of the platoon, and thereafter orient the housing to point the aperture in a direction of vehicle travel, wherein the controller is further programmed to limit a minimum size of an inner diameter of the aperture to two inches.

11. The vehicle of claim 10, wherein the controller is further programmed to size the inner diameter at least equal to one wavelength of electromagnetic radiation transmitted from the antenna.

12. The vehicle of claim 10, wherein the controller is further programmed to transmit the data via the antenna at a frequency between 5.850 and 5.925 GHz.

13. The vehicle of claim 10, wherein the vehicle event is indication of a flat tire.

14. The vehicle of claim 10, wherein the controller is further configured to adjust an elevation angle of the aperture, with respect to the antenna, based on an upcoming gantry having a toll collection system.

15. The vehicle of claim 10, wherein the controller is further configured to adjust a size of the aperture to decrease attenuation of electromagnetic radiation transmitted from the antenna to outside the housing.

16. The vehicle of claim 10, wherein the aperture is an iris diaphragm.

* * * * *